US006691993B2

(12) United States Patent
Anton

(10) Patent No.: US 6,691,993 B2
(45) Date of Patent: Feb. 17, 2004

(54) CLAMP

(76) Inventor: Con Anton, P.O. Box 540, Thomastown Victoria (AU)

( * ) Notice: Subject to any disclaimer, the term of this patent is extended or adjusted under 35 U.S.C. 154(b) by 0 days.

(21) Appl. No.: 10/203,569

(22) PCT Filed: Feb. 12, 2001

(86) PCT No.: PCT/AU01/00124

§ 371 (c)(1),
(2), (4) Date: Aug. 9, 2002

(87) PCT Pub. No.: WO01/58646

PCT Pub. Date: Aug. 16, 2001

(65) Prior Publication Data

US 2003/0025261 A1 Feb. 6, 2003

(30) Foreign Application Priority Data

Feb. 11, 2000 (AU) ..... PQ5599
Feb. 16, 2000 (AU) ..... PQ5670
May 26, 2000 (AU) ..... PQ7792

(51) Int. Cl.[7] ..... B25B 5/14

(52) U.S. Cl. ..... 269/111; 269/147; 269/155; 269/164; 29/281.1

(58) Field of Search ..... 269/111, 147, 269/155, 164, 901; 29/281.1, 281.6

(56) References Cited

U.S. PATENT DOCUMENTS 1,206,639 A * 11/1916 Youngquist et al. ..... 269/147
2,525,204 A * 10/1950 Calabro ..... 269/147
4,427,191 A * 1/1984 Hess ..... 269/43
4,456,043 A * 6/1984 Stocks ..... 269/155
4,552,345 A * 11/1985 Benda et al. ..... 269/43
4,648,160 A 3/1987 Spinosa et al.
4,671,500 A * 6/1987 Mark ..... 269/228

FOREIGN PATENT DOCUMENTS

JP 08126965 A 5/1996

* cited by examiner

*Primary Examiner*—Lee D. Wilson
(74) *Attorney, Agent, or Firm*—Volpe and Koenig, P.C.

(57) ABSTRACT

A clamp comprises at least two opposed clamping surfaces and at least two opposed second clamping surfaces disposed perpendicularly to them, at least two opposed pressure-bearing surfaces spaced apart and located on longitudinal axes of the first clamping surfaces and disposed at an angle from the first clamping surfaces, and two rigid pressure-bearing points, one of the pressure-bearing points located to align when in use adjacent to one of the pressure-bearing surfaces and the other pressure-bearing point located to align when in use adjacent to the other pressure-bearing surface. A device or manner of imparting a longitudinal force such that the pressure-bearing surfaces are urged against the pressure-bearing points is also included. As the angled pressure-bearing surfaces slide over the pressure-bearing points in response to the longitudinal force, that longitudinal force is translated into a clamping force that urges the opposed clamping surfaces towards each other.

7 Claims, 7 Drawing Sheets

CLAMP

FIELD OF INVENTION

This invention relates to clamps and presses that may be used in many industries and are suitable for finely controlled clamping and pressing of any materials including plastics, metal and timber.

In particular the invention relates to a clamp suitable for use with timber such as in the manufacture of items of furniture.

BACKGROUND OF THE INVENTION

In furniture making and similar timber-working, solid timber is often glued edge-to-edge to form a solid timber panel, in which case pressure is applied to both the edges and faces of the panel. Additionally, in some instances flat panels of solid, ply and/or veneer timber are constructed by pressing the timber surfaces together. In this case pressure is applied only to the faces of the panel. Such flat panels often are used in the manufacture of doors.

Most commonly, the traditional type of clamp, known as a sash clamp, has been used in panel manufacture. However, it is very difficult to make quality panels by the use of this method because sash clamps were not designed for that particular purpose. The panels produced are almost always uneven.

In an attempt to improve that method of manufacture, a flattener is used. The flattener uses a system similar to a sash clamp to push down the surface of the panel to straighten it. The device can operate by pneumatic or screw means or by "gee" clamps. This, of course, adds an extra operation to the panel making process and can be very time consuming.

The applicant is aware of other methods to achieve the result of the present invention but they involve the use of complex and expensive apparatus. An example of such apparatus is known as a Mill Press, which has rotating frames all around and occupies a large amount of space. The use of a Mill Press is not limited to timber but generally a Mill Press will only be used by the larger factories because the cost of each press can often be more than AU$15,000.

Consequently, there is a need for a pressing device that is simple in its construction and operation and is able, if required, to press a panel of timber in two dimensions simultaneously.

The present invention seeks to meet this need.

SUMMARY OF THE INVENTION

This invention accordingly provides a clamp comprising:

at least two opposed first clamping surfaces, at least two opposed second clamping surfaces disposed perpendicularly to the planes of the first clamping surfaces, at least two opposed pressure-bearing surfaces spaced apart and located on longitudinal axes of the first clamping surfaces and disposed at an angle from the first clamping surfaces, and two rigid pressure-bearing points, one of said pressure-bearing points located to align when in use adjacent to one of the pressure-bearing surfaces and the other pressure-bearing point located to align when in use adjacent to the other pressure-bearing surface; and means for imparting a longitudinal force such that the pressure-bearing surfaces are urged against the pressure-bearing points and, as the angled pressure-bearing surfaces slide over the pressure-bearing points in response to the longitudinal force, that longitudinal force is translated into a clamping force that urges the opposed clamping surfaces towards each other.

PREFERRED ASPECTS OF THE INVENTION

In a particularly preferred aspect, the invention provides a clamp comprising:

two opposed clamping components each having (i) a first clamping surface, (ii) a second clamping surface disposed perpendicularly to the plane of the first clamping surface, (iii) a pressure-bearing surface located on a longitudinal axis of the first clamping surface and disposed at an angle from the first clamping surface and (iv) a rigid pressure-bearing point located to align when in use adjacent to the pressure-bearing surface of the second clamping component;

means for imparting a longitudinal force to the clamping components such that the pressure-bearing surface of one clamping component is urged against the pressure-bearing point of the other clamping component and, as the angled pressure-bearing surfaces slide over the pressure-bearing points in response to the longitudinal force, that longitudinal force is translated into a clamping force that urges the first and second clamping surfaces of one clamping component towards the first and second clamping surfaces, respectively, of the opposed clamping component.

It is preferred that the pressure-bearing surface is disposed at an angle of about 60°. In some circumstances, where it is desired to alter the pressure applied to a work-piece, a more acute angle can be used. It is preferred that the pressure-bearing surface is fixed at a given angle but, alternatively, the clamping component may be adapted so that the pressure-bearing surface can swivel to provide a variation in angle. Alternatively, the pressure-bearing surface may be curved rather than linear to differentially exert pressure to a work-piece as longitudinal force is applied to the clamping components.

It is further preferred that there is a plurality of rigid pressure-bearing points arranged so that the two clamping components may be inter-engaged at any of the points thus allowing for the accommodation of work-pieces of varied sizes.

In a more preferred embodiment, the rigid pressure-bearing points are movable from one point along the length of the clamping component to a plurality of other points.

A first clamping surface may be provided by one of the upper edges of a U-channel member and an additional first clamping surface may be provided by the other upper edge of the U-channel member. It is preferred that a stop member, having a pressure-bearing surface and a second clamping surface, may be fixed within the U-channel.

Preferably the means for exerting the said longitudinal force is a pressure-exerting device comprising a clamping plate adapted to engage with and exert force against a second clamping surface and a pressure plate operably attached to the clamping plate and adapted to be advanced towards and apply pressure to a work-piece located in the clamp.

Preferably the clamp includes an allowance for height adjustment of a stop member and incorporates a pressure-exerting device with the stop member.

It is particularly preferred that the clamp includes a pre-tension member that in operation of the pressure-exerting device provides resistance against the pressure plate and thus begin the movement of the first clamping surface towards the work-piece before the work-piece is compressed against the second clamping surface. (Without this improvement, in some cases where the work-piece is bowed or uneven the compression of the second clamping surface against the work-piece does not allow enough relative lateral movement of the two clamping components to provide sufficient clamping force from the first clamping surface.) The pre-tension member comprises a bearing plate mounted perpendicularly on a slide that runs along a groove in the U-channel member against the bias of a spring that is attached to a stop pin.

An alternative use of the pre-tension member is obtained by positioning it distal to the edge of the work-piece so that the movement of the bearing plate is limited by the stop pin before the bearing plate bears against the edge of the work-piece. By this means there is no pressure against the edges of the work-piece but only pressure exerted against the faces of the work-piece by the first clamping surfaces.

A flange and locating holes may be provided on the stop member so that the stop member may be fitted into a pair of grooves in the internal surface of the U-channel member in a sliding manner and be locked into position by a locating pin passed through a locating hole on the stop member and a mating hole on the U-channel member.

In addition, a joining member may be provided with a pair of flanges adapted to fit within corresponding grooves within a U-channel member and to thus join two U-channel members end-to-end.

It is further preferred that the clamp is adapted to be mounted on a carriage for the purpose of ready and controlled positioning of the clamp such that a clamp can be positioned instantly to suit a particular work-piece and to maintain an accurate alignment (usually of 90°).

BRIEF DESCRIPTION OF THE DRAWINGS

In order that the invention may be better understood, a preferred embodiment will now be described with reference to the accompanying drawings in which.

Integer List:

| | |
|---|---|
| 1 | clamp, |
| 2 | U-channel member, |
| 3 | size-adjustment hole, |
| 4 | measure bearing surface, |
| 5 | first clamping surface, |
| 6 | second clamping surface, |
| 7 | size-adjustment locating pin, |
| 8 | pressure plate, |
| 9 | clamping plate, |
| 10 | screw-threaded rod, |
| 11 | tightening hole, |
| 12 | T-section supporting bracket, |
| 13 | carriage plate, |
| 14 | bearing wheel, |
| 15 | spindle, |
| 16 | attachment lug, |
| 17 | attachment aperture, |
| 18 | timber plank, |
| 19 | clamping component; |
| 20 | pressure exerting device; |
| 21 | supporting carriage; |
| 22 | stop-member; |
| 23 | pulling adaptor; |
| 24 | attachment hole; |
| 25 | pulling arm; |
| 26 | washer; |
| 27 | nut head; |
| 28 | groove; |
| 29 | slot; |
| 30 | modified pressure exerting device; |
| 31 | aperture. |

DETAILED DESCRIPTION WITH RESPECT TO THE DRAWINGS

Figure 1:
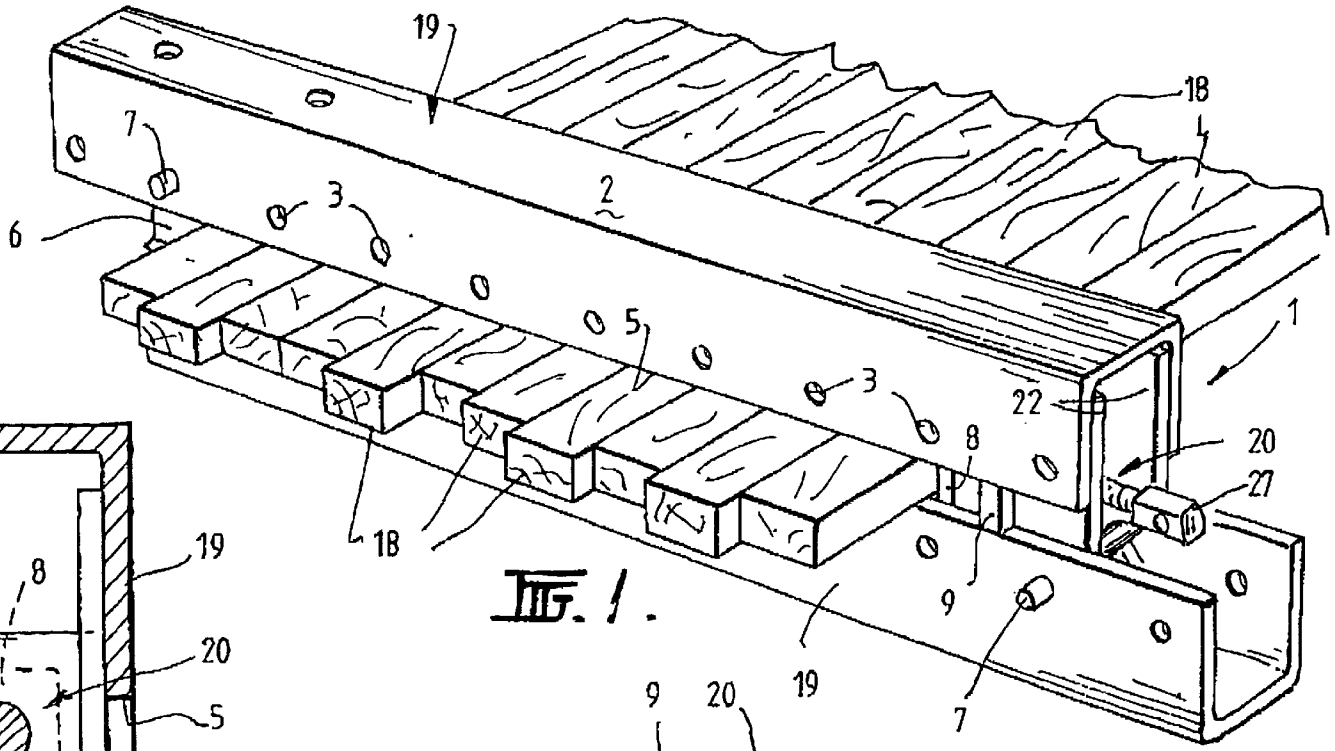
FIG. 1 is a side perspective view of a clamp according to the invention, shown in use for the purpose of butting several planks of timber edge-to-edge and applying pressure to both the faces and edges of the work-piece.

A clamp (1) according to the invention is shown in FIG. 1 in use for joining timber planks (18) by butting them edge-to-edge and applying pressure in two dimensions simultaneously.

In this case, pressure is applied to the edge of the plank (18) by a pressure plate (8) at one end of the clamp and by a second clamping surface (6) at the opposite end of the clamp. Pressure is applied to the face of the panel of planks (18) by a first clamping surface (5) of each clamping component (19) of the clamp (1). The first (5) and second (6) clamping surfaces, and the spatial relationship between them, are best illustrated in FIG. 2.

Figure 4:
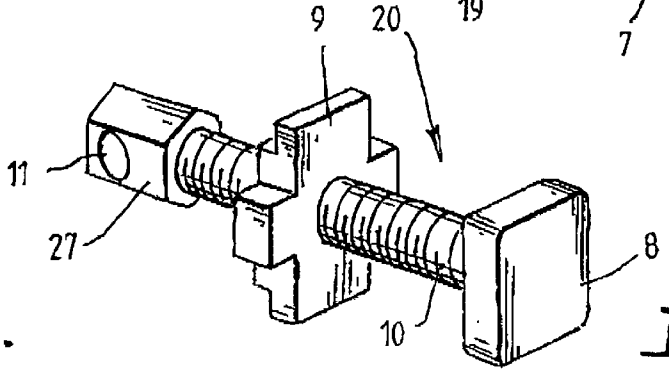
FIG. 4 is a perspective view of a pressure-exerting device for use with the clamping components of FIG. 2 in the functional relationship shown in FIG. 1.
Figure 3:
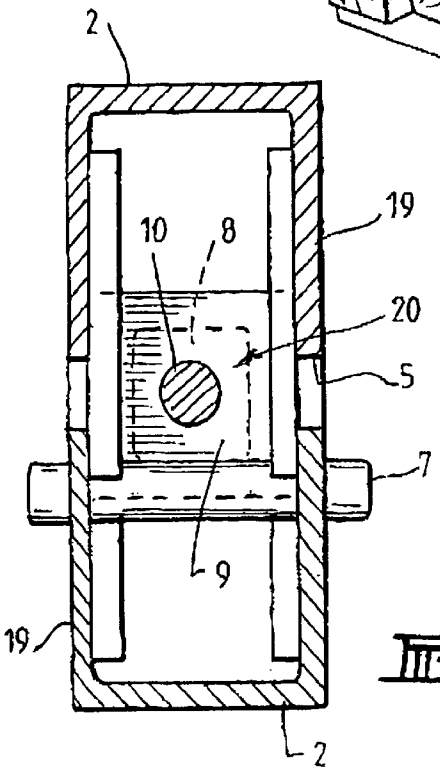
FIG. 3 is an end view in cross-section of an assembled clamp according to the invention.
Figure 2:
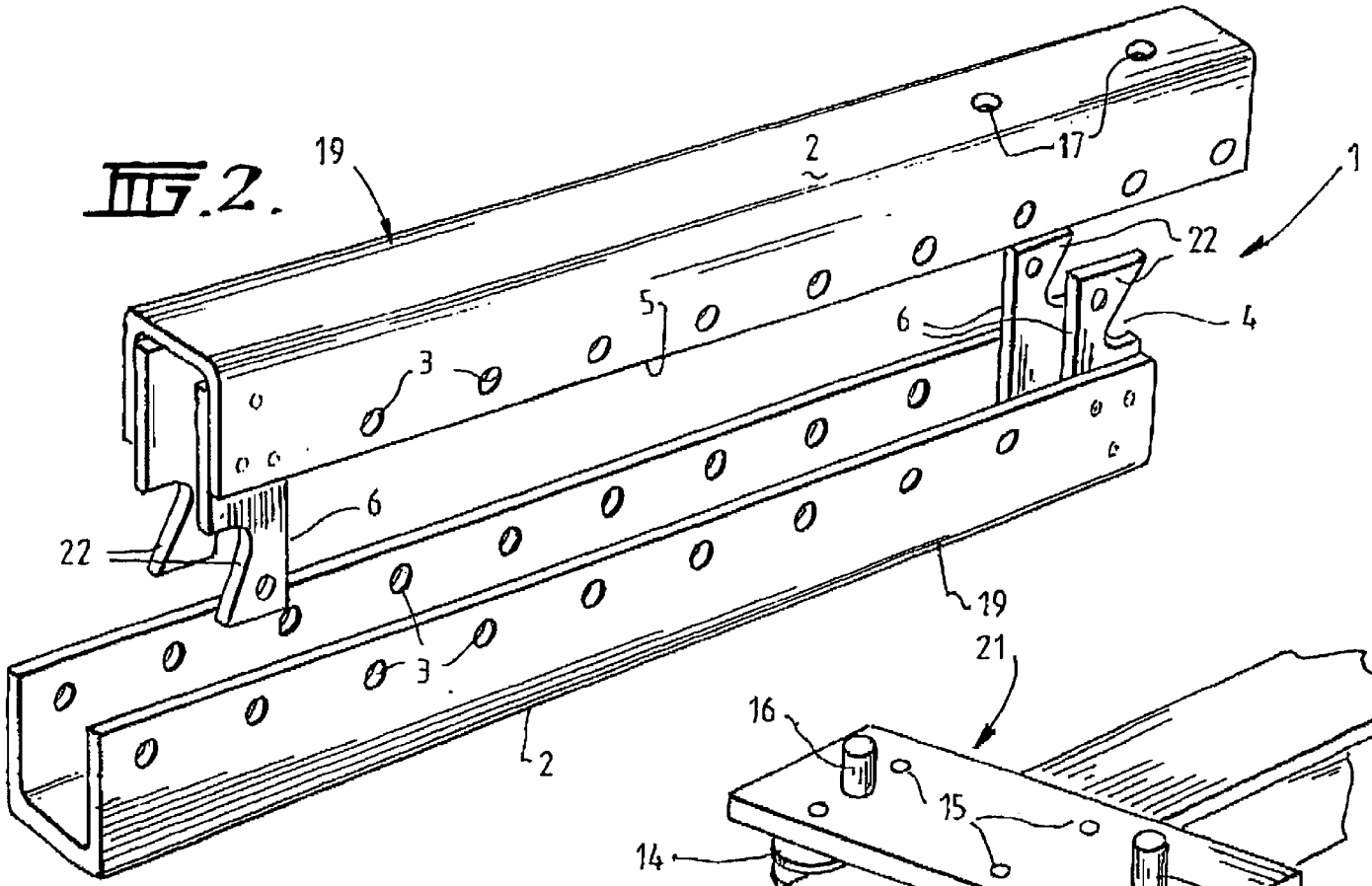
FIG. 2 is a side perspective view of two clamping components of the clamp according to the invention shown in FIG. 1.

The clamp (1) comprises two identical clamping components (19), two size-adjustment locating pins (7) and a pressure-exerting device (20); as are illustrated in FIGS. 2, 3 and 4.

The clamping component (19) is constructed from medium section alloy and comprises a U-channel member (2). Along each upper edge of the U is a first clamping surface (5) that applies force to the face of a panel in the clamp (as shown in FIG. 1). Fixed within the channel (by means of screws as shown in FIG. 2 but similarly could be by means of rivets or bolts or permanent means such as welding) are two rigid upright stop-members (22), each having a pressure-bearing surface (4) and a second clamping surface (6). The pressure-bearing surface (4) is aligned at a fixed angle of about 60° C. relative to the longitudinal axis of the first clamping surface (5) whilst the second clamping surface (6) is perpendicular to the first clamping surface (5). It is the second clamping surface (6) that applies force to the edge of a clamped panel.

Along the arms of the U-channel member (2) is a series of size adjustment holes (3), each hole adapted to accommodate a size-adjustment pin (7). The size adjustment pins (7) also serve the purpose of providing a rigid pressure-bearing point against which the pressure-bearing surface (4) can interact.

The pressure-exerting device (20) comprises a screw-threaded rod (10) pivotally mounted at one end to a pressure plate (8) and passing through and making screw-threaded engagement with a clamping plate (9). The clamping plate (9) is adapted to engage the second clamping surface (6) of one of the clamping components (19). The pressure-exerting device (20) is arranged so that, by rotation of the screw-threaded rod (10), the pressure plate (8) will advance towards the timber work-piece and the clamping plate (9) will be urged against the second clamping surface (6). A tightening hole (11) is provided in the nut-head (27) of the distal end of the screw-threaded rod (10) so that a pin (not shown) may be inserted therein to provide added purchase when tightening the pressure device (20) against a work-piece. (Note: a similar device could be constructed by substituting the screw-threaded rod (10) with a mechanical device or pneumatic or hydraulic cylinder.)

The clamp (1) is assembled as shown in FIG. 1. The size-adjustment locating pins (7) are placed in the appropriate size-adjustment holes (3) depending upon the width of the desired timber panel and the pressure device (20) is located between one edge of the timber work-piece and one of the second clamping surfaces (6). As the pressure-exerting device (20) is extended, exerting pressure on both the work-piece and the second clamping surface (6) a longitudinal force is applied to the clamping components (19) causing a longitudinal sliding movement of one relative to the other. This movement urges the pressure-bearing surfaces (4) against the rigid locating pins (7). As the angled pressure-bearing surfaces (4) slide over the locating pins (7) the longitudinal force is translated into a perpendicular clamping force that urges the first clamping surfaces (5) towards the work-piece. Thus, by the one tightening action of the pressure-exerting device, clamping pressure is applied to the work-piece in two dimensions at right angles to each other.

Figure 6:
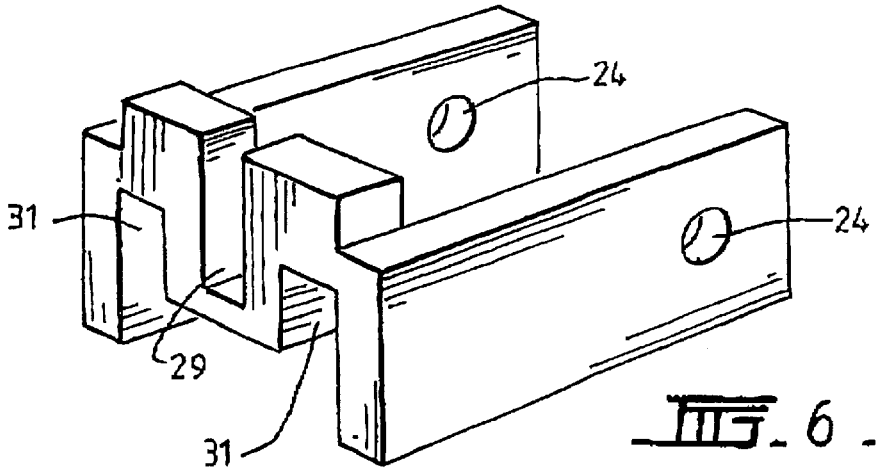
FIG. 6 is a perspective view of an adaptor for use with the clamp when pressing in one dimension only.
Figure 7:
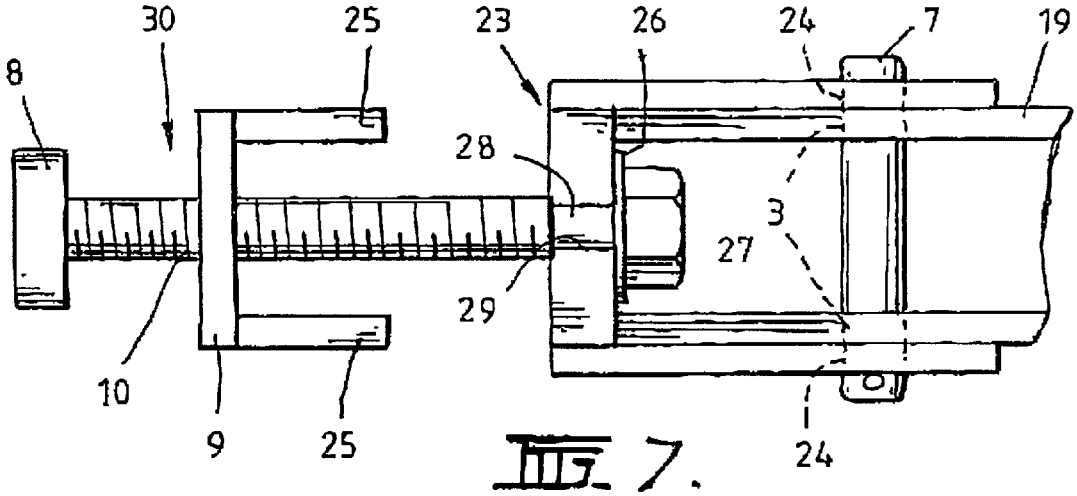
FIG. 7 is a top view of the adaptor of FIG. 6 in association with a modified pressure-exerting device of FIG. 4 and attached to a clamping component.

When it is desired to apply pressure to the work-piece at the faces only, an adaptor (23) and a modified pressure-exerting device (30) are used as shown in FIGS. 6 and 7.

The adaptor (23), as shown in FIG. 6, is shaped to fit over one end of a clamping component (19) and has two locating holes (24) positioned to align with a pair of size-adjustment holes (3) in the clamping component (19). The adaptor (23) is attached to the clamping component (19) by passing a locating pin (7) through the aligned holes (24) and (3). The adaptor (23) also has a slot (29) that is able to receive and retain the modified pressure-exerting device (30).

Figure 8:
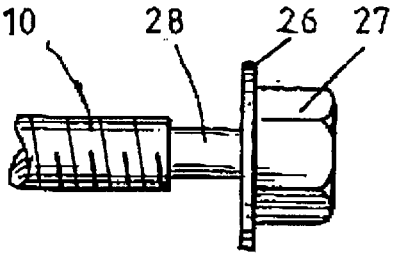
FIG. 8 is a detailed enlargement of the nut head region of the pressure-exerting device shown in FIG. 7.
Figure 9:
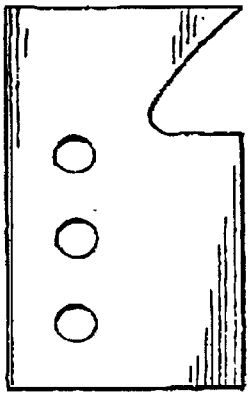
FIG. 9 is a side view of a stop member having a concave curved pressure-bearing surface.
Figure 10:
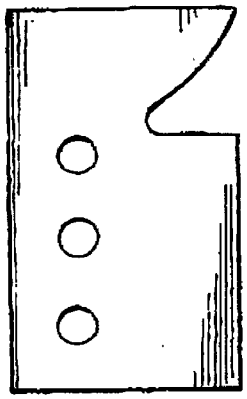
FIG. 10 is a side view of a stop member having a convex curved pressure-bearing surface.
Figure 11:
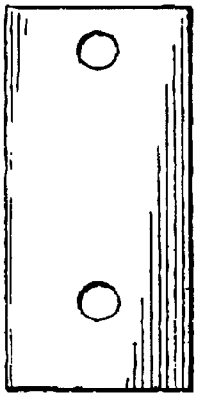
FIG. 11 is a view of the face of a stop member showing the second clamping surface, which has two holes to allow the fixing of a cushioning material.
Figure 12:
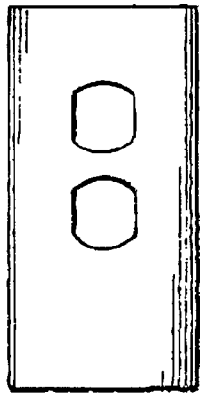
FIG. 12 is a view of the face of a stop member incorporating two fixed mounting points for a pressure-exerting device.
Figure 13:
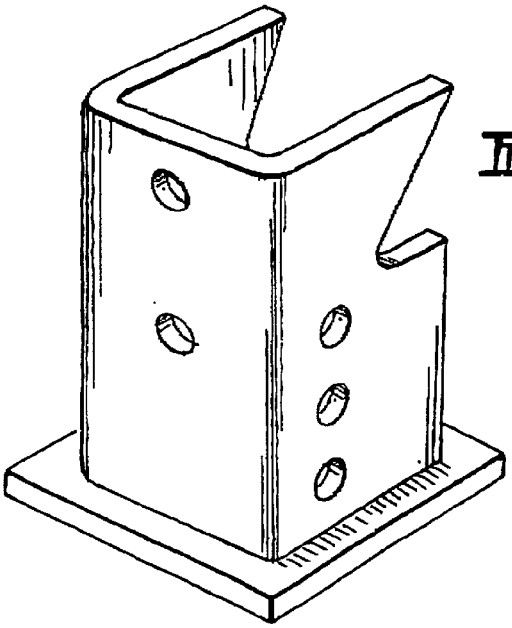
FIG. 13 is a perspective view of a stop member.
Figure 21:
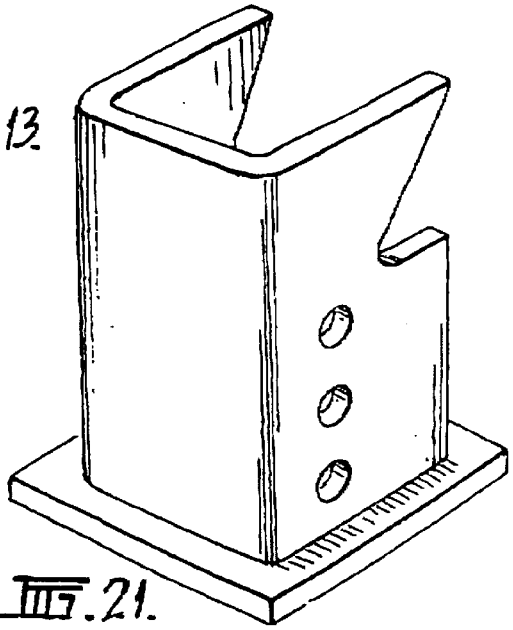
FIG. 21 illustrates the means for height adjustment of a stop member.
Figure 16:
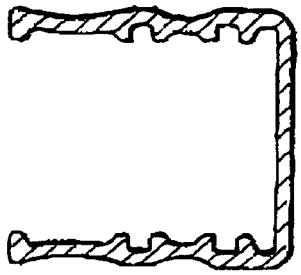
FIG. 16 is a cross section of the U-channel member of FIG. 15.
Figure 17:
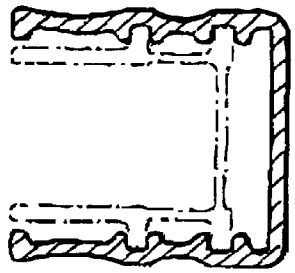
FIG. 17 is a cross section as in FIG. 15 but including the joining member of FIG. 14 (shown in dotted form) to illustrate the spatial relationship of the joining member to the U-channel member when joining two U-channel members together.
Figure 14:
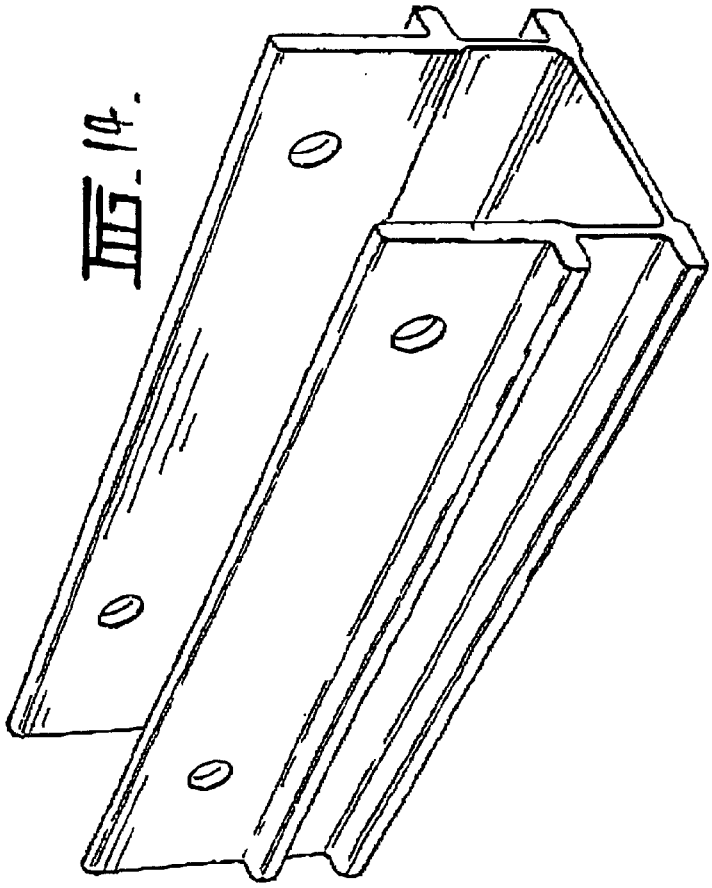
FIG. 14 is a perspective view of a joining member.
Figure 15:
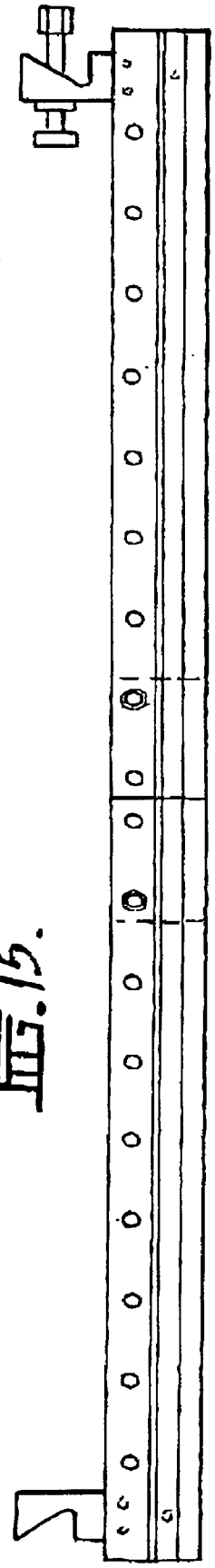
FIG. 15 is a side view of a clamping component that comprises two U-channel members joined end-to-end by the joining member of FIG. 14 (shown in dotted form).

The modified pressure-exerting device (30) is closely based on the standard pressure-exerting device (20) as can be seen in FIGS. 7 and 8 in comparison to FIG. 4. The modifications comprise the addition of two pulling arms (25) to the clamping plate (9) and the provision of a groove (28) and washer (26) between the nut-head (27) and threaded rod (10). The groove (28) is shaped to fit within the slot (29) of the adaptor (23) as shown in FIG. 7.

Longitudinal "pulling" force is applied to the clamping component (19) through the washer (26) by shortening the modified pressure-exerting device (30) by rotation of the threaded rod (10). As the device (30) shortens, the pulling arms (25) move through the apertures (31) in the adaptor (23) and are urged against the second clamping component (19). By this action there is a "pulling" force applied to the upper clamping component (19) and a "pushing" force applied to the lower clamping component (19). This results in a longitudinal sliding movement of one component relative to the other urging the pressure-bearing surfaces (4) against the rigid locating pins (7) which is translated into a clamping force that urges the first clamping surfaces (5) towards the work-piece. In this particular arrangement, however, there is no pressure applied to the edge of the work-piece and thus the clamping action is in one dimension only.

Figure 18:
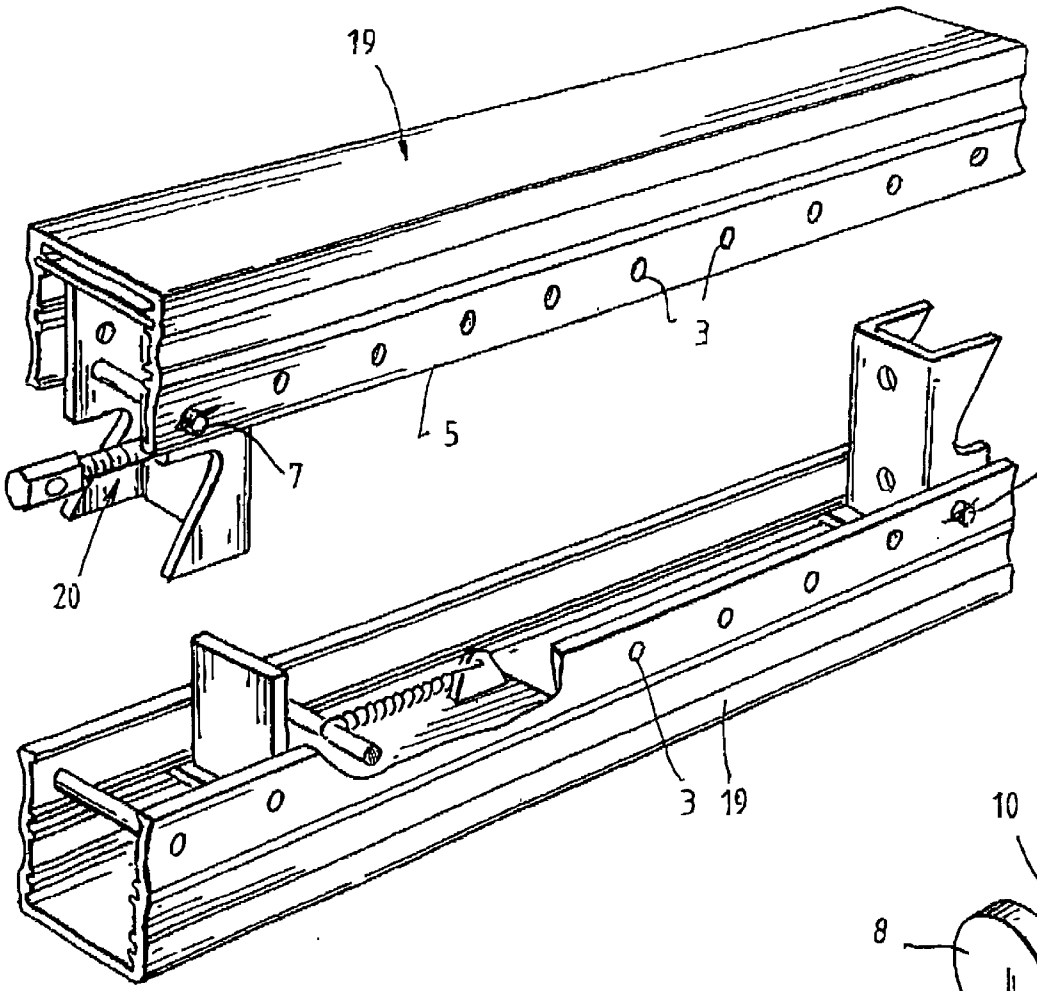
FIG. 18 shows a clamp according to the invention including the improvement of a movable pre-tension member.
Figure 20:
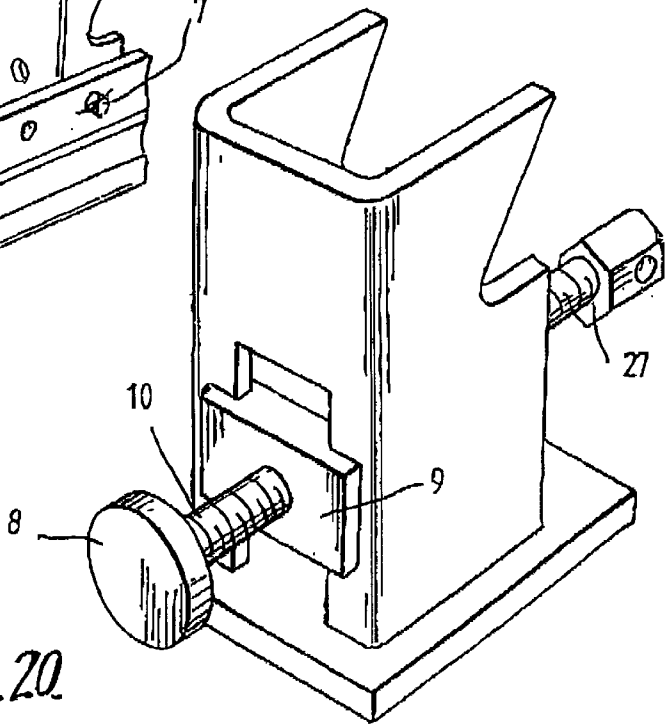
FIG. 20 illustrates the means for variable height adjustment of a pressure-exerting device.
Figure 19:
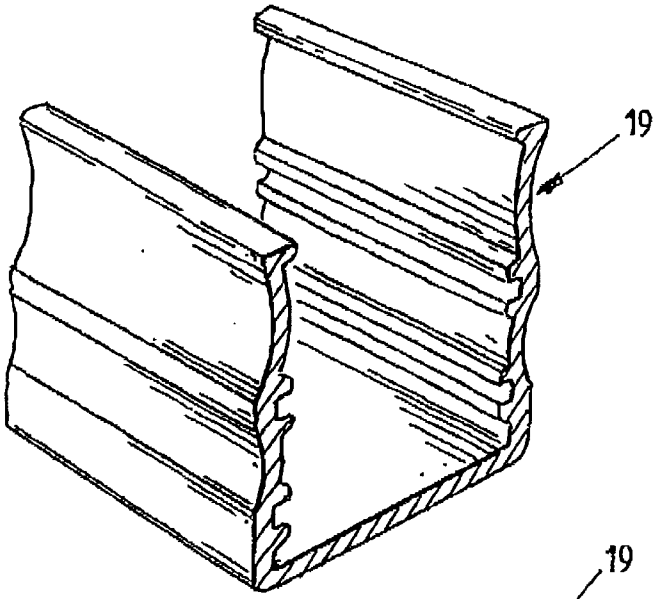
FIG. 19 is an end perspective view of the press U-channel member.
Figure 22:
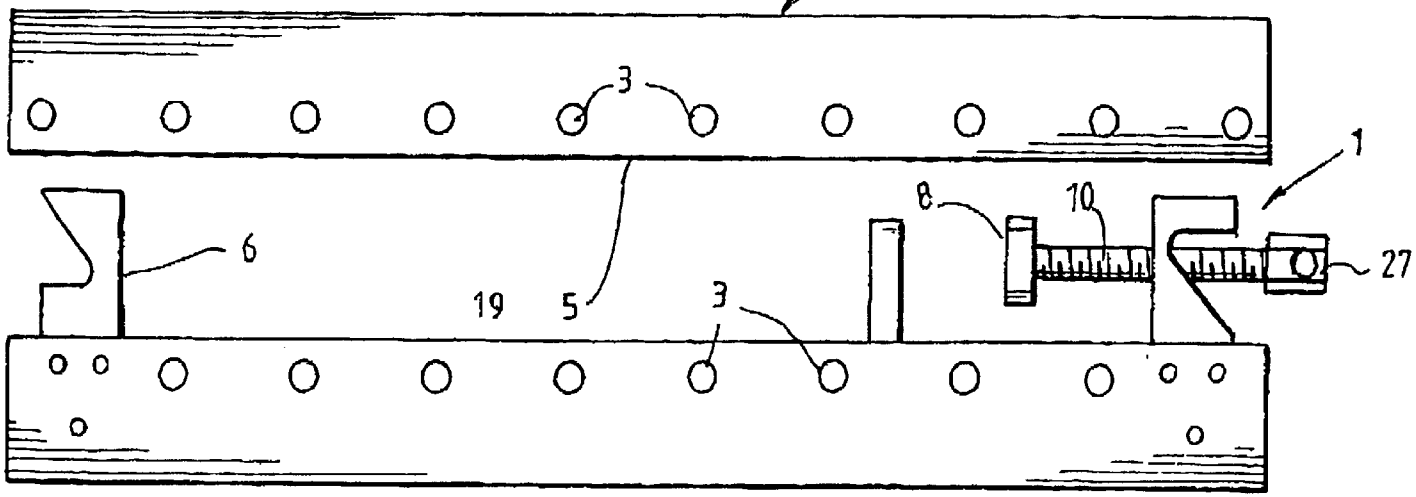
FIG. 22 illustrates an alternative embodiment of a clamp according to the invention in which the clamp components are assembled around a work-piece then locked into position by the insertion of locating pins through the holes shown to bear agai the pressure-bearing surfaces.

Shown in FIGS. 18 and 22 are two variations of a clamp incorporating a pre-tension member for use with a pressure-exerting device (20). The pre-tension member comprises a bearing plate mounted perpendicularly on a slide that runs along a groove in the U-channel member against the bias of a spring that is attached to a stop pin.

An alternative use of the pre-tension member is obtained by positioning it distal to the edge of the work-piece so that the movement of the bearing plate is limited by the stop pin before the bearing plate bears against the edge of the work-piece. By this means there is no pressure against the edges of the work-piece but only pressure exerted against the faces of the work-piece by the first clamping surfaces.

To add to the versatility of the clamp according to the invention, in particular to allow for the manipulation of work-pieces varying in size from small to large and heavy, a supporting carriage is provided.

Figure 5:
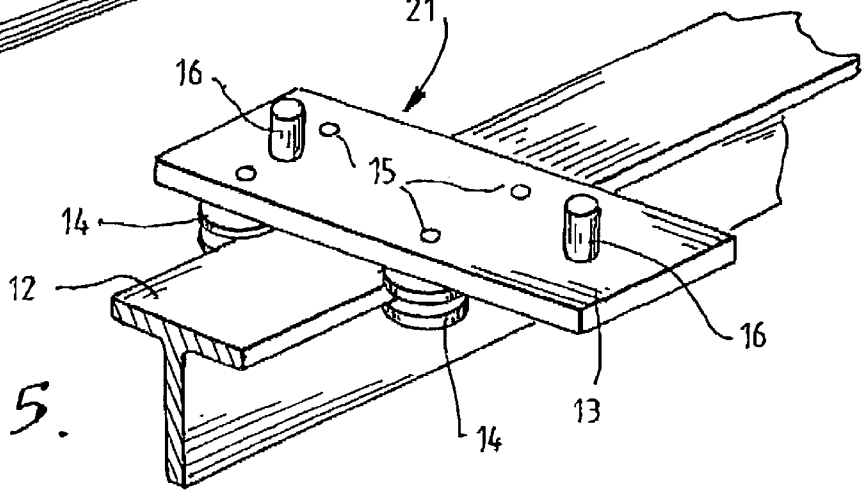
FIG. 5 illustrates a movable carriage upon which a clamp according to the invention may be mounted.

The supporting carriage (21), shown in FIG. 5, comprises a T-section supporting bracket (12) that may be mounted on a frame if desired (Note: in an alterative structure, the supporting bracket could be constructed in H-section.) Mounted on the supporting bracket (12) is a planar carriage plate (13) provided with two upstanding attachment lugs (16) that engage with two attachment apertures (17) in the base of the U-section channel member (2) of a clamping component (19). Mounting of the carriage plate (13) and means to allow movement along the supporting bracket (12)

is provided by four bearing wheels (14) that are attached to the carriage plate (13) by spindles (15). The bearing wheels (14) are adapted to engage with the cross-arms of the T-section of the supporting bracket (12).

The clamp herein described in accordance with the invention has several advantages over the prior art.

In particular it can provide even clamping pressure to a work-piece in both horizontal and vertical dimensions by a single and simple clamping movement. However, if desired, a similar single and simple clamping movement can apply pressure in one dimension only without applying pressure to the edges of the work-piece.

By its simple clamping movement, the clamp is easy to use and the pressure applied can be easily and finely adjusted. Further adjustment can be achieved by varying the angle of the pressure-bearing surface of the stop-members. Such variation can be effected by replacing the existing stop-members with other stop-members having their pressure-bearing surfaces at different angles. Alternatively, the stop-member may be adapted by pivot means so that the angle of its pressure-bearing surface can be adjusted and fixed at varied angles. If the angle of the pressure-bearing surface is more acute then more pressure is applied to the flat surfaces of the work-piece rather than the edges.

In the configuration described, the clamp can be used in the same manner as a traditional sash clamp but also can be used as a panel press in manufacture of veneer or an edge-to-edge press as illustrated herein.

It will be appreciated that, whilst the foregoing has been given by way of illustrative example of the invention, all such modifications and variations thereto as would be apparent to persons skilled in the art are deemed to fall within the broad scope and ambit of the invention as defined in the following claims.

Further, it is to be understood that the words "comprise", "comprises", "comprising", comprised" or the like, when used in this specification, are to be given a non-exhaustive meaning.

What is claimed is:

1. A clamp comprising:

at least two opposed first clamping surfaces, at least two opposed second clamping surfaces disposed perpendicularly to the planes of the first clamping surfaces, at least two opposed pressure-bearing surfaces spaced apart and located on longitudinal axes of the first clamping surfaces and disposed at an angle from the first clamping surfaces, and two rigid pressure-bearing points, one of said pressure-bearing points located to align when in use adjacent to one of the pressure-bearing surfaces and the other pressure-bearing point located to align when in use adjacent to the other pressure-bearing surface; and means for imparting a longitudinal force such that the pressure-bearing surfaces are urged against the pressure-bearing points and, as the angled pressure-bearing surfaces slide over the pressure-bearing points in response to the longitudinal force, that longitudinal force is translated into a clamping force that urges the opposed clamping surfaces towards each other.

2. A clamp comprising:

at least two opposed first clamping surfaces, at least two opposed second clamping surfaces disposed perpendicularly to the planes of the first clamping surfaces, at least two opposed pressure-bearing surfaces spaced apart and located on longitudinal axes of the first clamping surfaces and disposed at an angle from the first clamping surfaces, and two rigid pressure-bearing points, one of said pressure-bearing points located to align when in use adjacent to one of the pressure-bearing surfaces and the other pressure-bearing point located to align when in use adjacent to the other pressure-bearing surface;

two opposed clamping components each having (i) a first clamping surface, (ii) a second clamping surface disposed perpendicularly to the plane of the first clamping surface, (iii) a the pressure-bearing surface located on a longitudinal axis of the first clamping surface and disposed at an angle from the first clamping surface and (iv) a rigid pressure-bearing point located to align when in use adjacent to the pressure-bearing surface of the second clamping component; and means for imparting a longitudinal force to the clamping components such that the pressure-bearing surface of one clamping component is urged against the pressure-bearing point of the other clamping component and, as the angled pressure-bearing surfaces slide over the pressure-bearing points in response to the longitudinal force, that longitudinal force is translated into a clamping force that urges the first and second clamping surfaces of one clamping component towards the first and second clamping surfaces, respectively, of the opposed clamping component.

3. The clamp according to claim 2 in which the means for exerting the said longitudinal force is a pressure-exerting device comprising a clamping plate adapted to engage with and exert force against a second clamping surface and a pressure plate operably attached to the clamping plate and adapted to be advanced towards and apply pressure to a work-piece located in the clamp.

4. The clamp according to claim 3 which includes a pre-tension member that in operation of the pressure-exerting device provides resistance against the pressure plate and thus begins the movement of the first clamping surface towards the work-piece before the work-piece is compressed against the second clamping surface.

5. The clamp according to claim 4 in which a first clamping surface is provided by one of the upper edges of a U-channel member and an additional first clamping surface is provided by the other upper edge of the U-channel member and in which a stop member having a pressure-bearing surface and a second clamping surface is fixed within the U-channel.

6. The clamp according to claim 5 in which the pre-tension member comprises a bearing plate mounted perpendicularly on a slide that runs along a groove in the U-channel member against the bias of a spring that is attached to a stop pin.

7. The clamp according to claim 6 including a flange and locating holes provided on the stop member so that the stop member may be fitted into a pair of grooves in the internal surface of the U-channel member in a sliding manner and be locked into position by a locating pin passed through a locating hole on the stop member and a mating hole on the U-channel member.

* * * * *